US006073711A

United States Patent [19]

Ingmarsson

[11] Patent Number: 6,073,711

[45] Date of Patent: Jun. 13, 2000

[54] PARTIALLY ENHANCED DRILL BIT

[75] Inventor: Karl Ingmarsson, Houston, Tex.

[73] Assignee: Sandvik AB, Sandviken, Sweden

[21] Appl. No.: 08/912,404

[22] Filed: Aug. 18, 1997

[51] Int. Cl.[7] ..... E21B 10/36

[52] U.S. Cl. ..... 175/420.2; 175/431; 175/434

[58] Field of Search ..... 166/420.2, 434, 166/418, 420.1, 428, 431, 414, 426

[56] References Cited

U.S. PATENT DOCUMENTS

| | | | |
|---|---|---|---|
| 4,832,139 | 5/1989 | Minikus et al. | 175/374 |
| 5,335,738 | 8/1994 | Waldenstrom et al. | 175/426 X |
| 5,370,195 | 12/1994 | Keshavan et al. | 175/420.2 |
| 5,636,700 | 6/1997 | Shamburger | 175/374 X |

*Primary Examiner*—Roger Schoeppel

*Attorney, Agent, or Firm*—Burns, Doane, Swecker & Mathis, L.L.P.

[57] ABSTRACT

A partially diamond-enhanced drill bit includes a bit body, at least one annular row of non-diamond enhanced buttons mounted in the bit body, and at least one annular row of diamond-enhanced buttons mounted in the bit body radially outside of the non-enhanced buttons. A total wear volume of the non-enhanced buttons in at least one row thereof is greater than 75 percent of a total wear volume of an outermost annular row of enhanced buttons. A number of non-enhanced buttons in one of the rows thereof is at least equal to a number of enhanced buttons in the outermost annular row thereof. At least some of the non-enhanced buttons have a greater wear volume than any of the enhanced buttons. The radially outermost row of non-enhanced buttons is displaced axially forwardly with respect to an adjacent row of enhanced buttons.

23 Claims, 7 Drawing Sheets

FIG. 5A
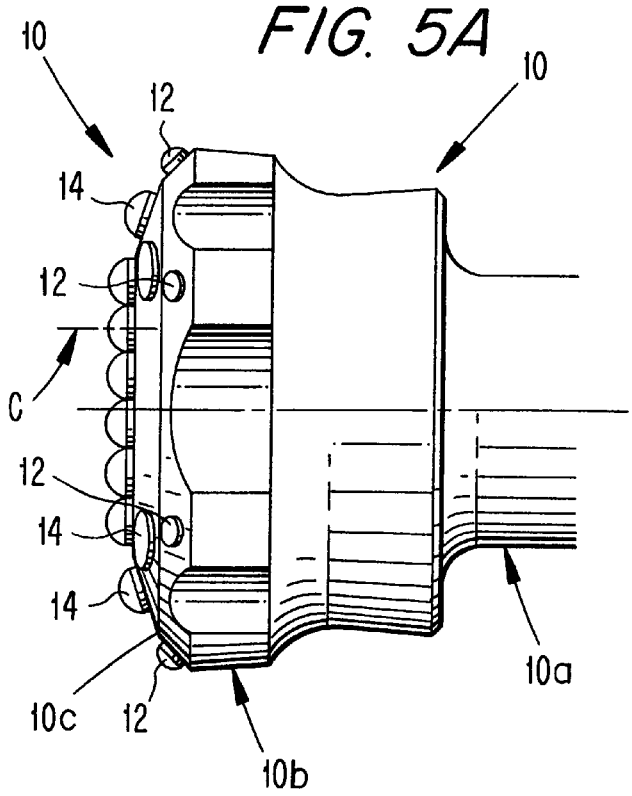
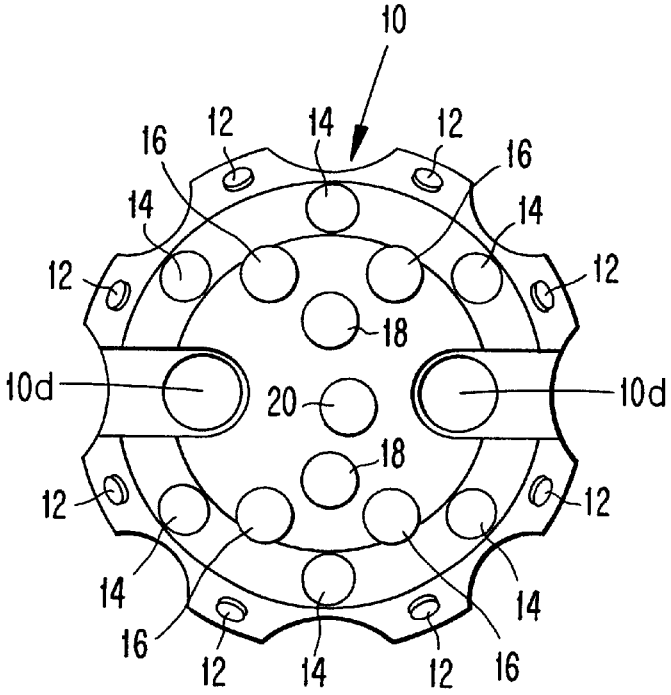
FIG. 5B

PARTIALLY ENHANCED DRILL BIT

BACKGROUND OF THE INVENTION

The present invention relates to partially enhanced drill bits for drilling in ground formations.

In percussive drilling in subterranean rock formations, a drill bit is alternatively rotated and impacted, whereby pieces of rock are broken away. The impacts can be generated locally by a down-the-hole piston, or from the ground surface.

A conventional drill bit for percussive drilling comprises a steel body with button inserts mounted on the drilling face. The buttons are arranged in generally concentric annular rows, with at least the outer row known as the gauge row, and the other rows known as the face rows. On larger bits, several outer rows may be referred to as gauge rows. The bit includes flushing holes for conducting flushing fluid that conducts-away the cuttings.

In order to minimize the rate of wear of the buttons, the buttons are usually formed of a hard material such as cemented carbide. The gauge row buttons perform the most work, and thus diamond-enhanced buttons are occasionally used as gauge buttons, i.e., buttons having a diamond layer applied thereto, such as natural or synthetic diamond. Bits having diamond enhanced gauge buttons, and non-diamond enhanced face buttons are called "partially-enhanced" bits. Bits wherein both the face buttons and gauge buttons are diamond-enhanced are called "fully enhanced" bits.

Conventional partially-enhanced bits 1, 2 and 3 are shown in FIGS. 1A–B, 2A–B and 3A–B, respectively, the bits being provided with diamond-enhanced gauge buttons 4D and cemented carbide (non-enhanced) buttons 4C.

FIGS. 4A and 4B depict how the buttons of a partially enhanced bit 5 become worn, the buttons including diamond-enhanced outer or gauge buttons 6D and non-enhanced (carbide) face buttons 6C. A fresh, unworn bit is depicted in FIG. 4A. The bit 5 is depicted in FIG. 4B after the non-enhanced buttons have been worn (the broken lines indicating the original shape of the buttons). Note that the enhanced buttons 6D are essentially unworn, due to their diamond layers. The wearing of the non-enhanced face buttons requires that the bit be pulled from the ground so that the non-enhanced face buttons can be re-shaped. As shown in FIG. 4B, it is necessary to remove some of the steel bit body to expose more of the face button to enable the face button to be re-shaped. Re-shaping is performed a number of times until the face buttons are so worn that the gauge buttons become overloaded and break.

The above-described problem could be addressed by using diamond-enhanced buttons in the face, but this solution greatly increases the cost of the bit.

It would be desirable to alleviate the problem in a more cost-effective way.

SUMMARY OF THE INVENTION

The present invention relates to a partially enhanced drill bit comprising a bit body, at least one annular row of non-enhanced buttons mounted in the bit body, and at least one annular row of enhanced buttons mounted in the bit body radially outside of the non-enhanced buttons. A total wear volume of non-enhanced buttons in at least one row thereof is greater than 75 percent of a total wear volume of an outermost annular row of enhanced buttons.

A number of the non-enhanced buttons in one of the rows thereof may be at least equal to a number of enhanced buttons in the outermost annular row thereof.

At least some of the non-enhanced buttons may have a greater wear volume than any of the enhanced buttons.

A radially outermost row of non-enhanced buttons may define a lower base plane which is displaced axially forwardly by a distance with respect to an upper base plane of an adjacent row of enhanced buttons disposed radially outwardly of the outermost row of non-enhanced buttons, the distance being at least 3.0 mm.

BRIEF DESCRIPTION OF THE DRAWINGS

The objects and advantages of the invention will become apparent from the following detailed description of preferred embodiments thereof in connection with the accompanying drawing in which like numerals designate like elements and in which:

FIG. 5A is a side elevational view of a drill bit according to a first embodiment of the invention;

FIG. 5B is a front end view of the drill bit depicted in FIG. 5A;

DETAILED DESCRIPTION OF PREFERRED EMBODIMENTS OF THE INVENTION

Figure 1A:
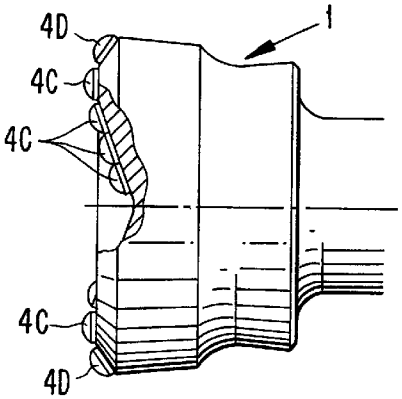
FIG. 1A (PRIOR ART)
FIGS. 1A, 2A and 3A are side elevational views of respective prior art drill bits.
Figure 2A:
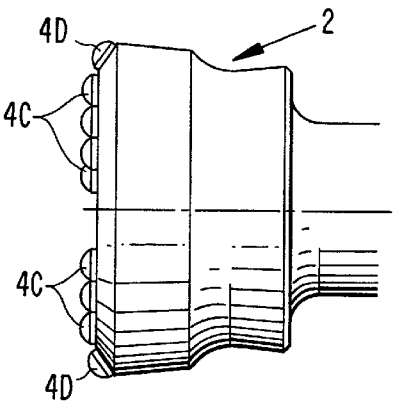
FIG. 2A (PRIOR ART)
Figure 3A:
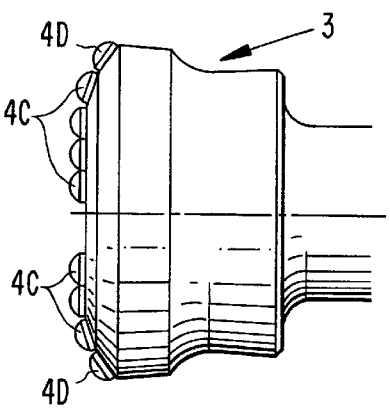
FIG. 3A (PRIOR ART)
Figure 1B:
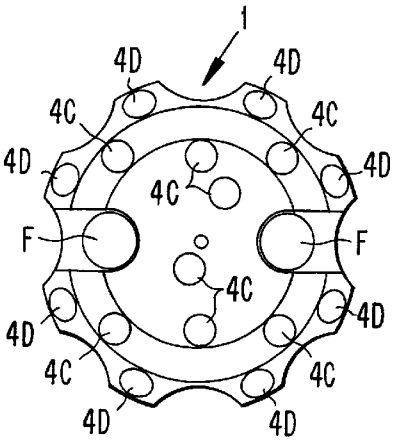
FIG. 1B (PRIOR ART)
FIGS. 1B, 2B and 3B are front end views of the conventional drill bits depicted in FIGS. 1A, 2A, 3A, respectively.
Figure 2B:
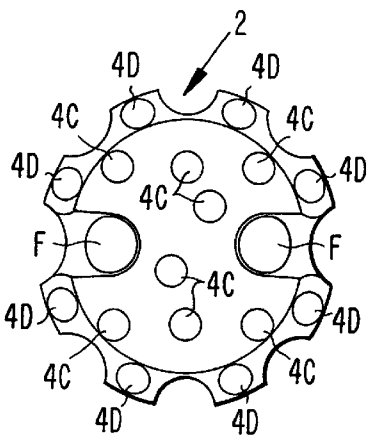
FIG. 2B (PRIOR ART)
Figure 3B:
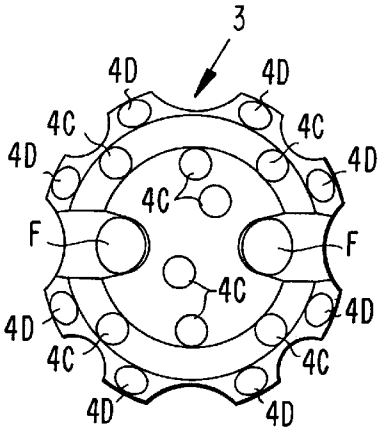
FIG. 3B (PRIOR ART)
Figure 4A:
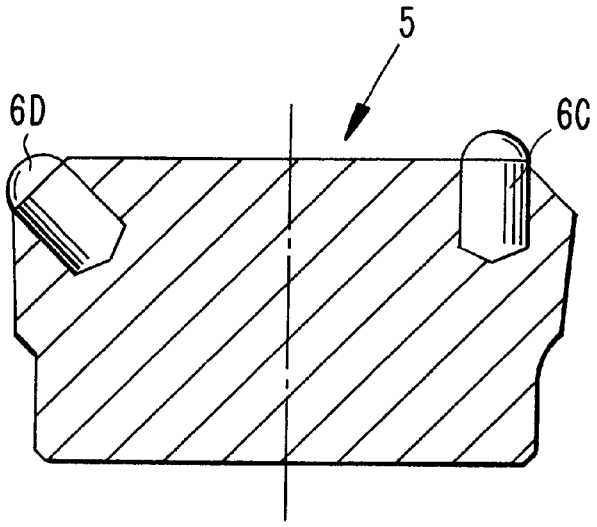
FIG. 4A (PRIOR ART)
FIG. 4A is a cross-sectional view through a portion of an unworn conventional drill bit.
Figure 4B:
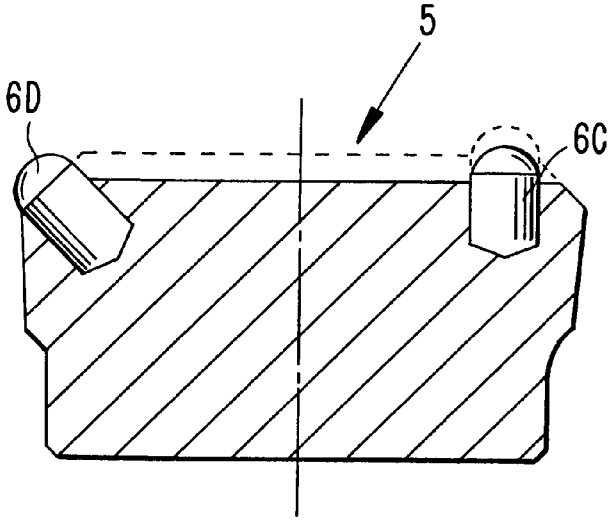
FIG. 4B (PRIOR ART)
FIG. 4B is a view similar to FIG. 4A after the drill bit has experienced wear and has been reshaped.

By "diamond-enhanced" or "enhanced" button as used herein is meant a button comprised of a non-diamond base, e.g., a cemented carbide base, on which a diamond (natural or synthetic) layer has been formed. A "non-enhanced" or "non-diamond-enhanced" button is a button which does not possess a diamond layer, e.g., a cemented carbide button. A "partially enhanced" bit comprises at least one gauge row of diamond enhanced buttons, and non-enhanced face buttons.

The "wear volume" of a button is the exposed volume outside of the bit body.

"Wear volume of a row" is the combined volume of all buttons located in the row. If some buttons have only a portion thereof projecting into a row, then only that portion counts toward calculating the wear volume of the row.

As will be explained, the present invention tends to balance the life-spans of the non-enhanced and enhanced buttons of a partially enhanced bit. In a first aspect of the invention this is achieved by an arrangement wherein the wear volume of at least one of the face rows is greater than seventy-five percent (75%) of the wear volume of the outermost diamond-enhanced row (i.e., the only row of diamond-enhanced buttons if only one row thereof is employed, or the outermost row if more than one row of enhanced buttons are used). As will be explained, that can be accomplished in terms of relative numbers of non-enhanced and enhanced buttons and/or relative sizes of non-enhanced and enhanced buttons. A second aspect of the invention for achieving a more balanced life-span of non-enhanced and enhanced buttons involves an axial relationship between those buttons. The first and second aspects can be utilized separately or together.

Turning now to the first aspect, a partially-enhanced drill bit 10, shown in FIGS. 5A and 5B, includes a shank portion 10*a*, and an integral head portion 10*b* having a cutting face 10*c*. A flushing channel extends through the shank portion and the head portion for conducting flushing fluid which exits a cutting face of the head portion via ports 10*d*. The bit 10 employs non-enhanced face buttons, at least some of which are larger than any of the diamond enhanced gauge buttons, in order to achieve the relationship wherein the wear volume of at least one of the face rows of non-enhanced buttons is greater than 75% of the wear volume of the outer row of enhanced buttons. Depicted in FIGS. 5A and 5B is a so-called convex percussive bit 10 having a gauge row of eight conventional diamond-enhanced button inserts (i.e., "buttons") 12, an outer or first annular face row of six conventional non-enhanced face buttons 14, a second annular row of four conventional non-enhanced face buttons 16, a third annular row of two conventional non-enhanced face buttons 18, and a conventional center non-enhanced face button 20. Each of the button is configured symmetrically about its own center axis, as is evident from the figures.

Figure 6:
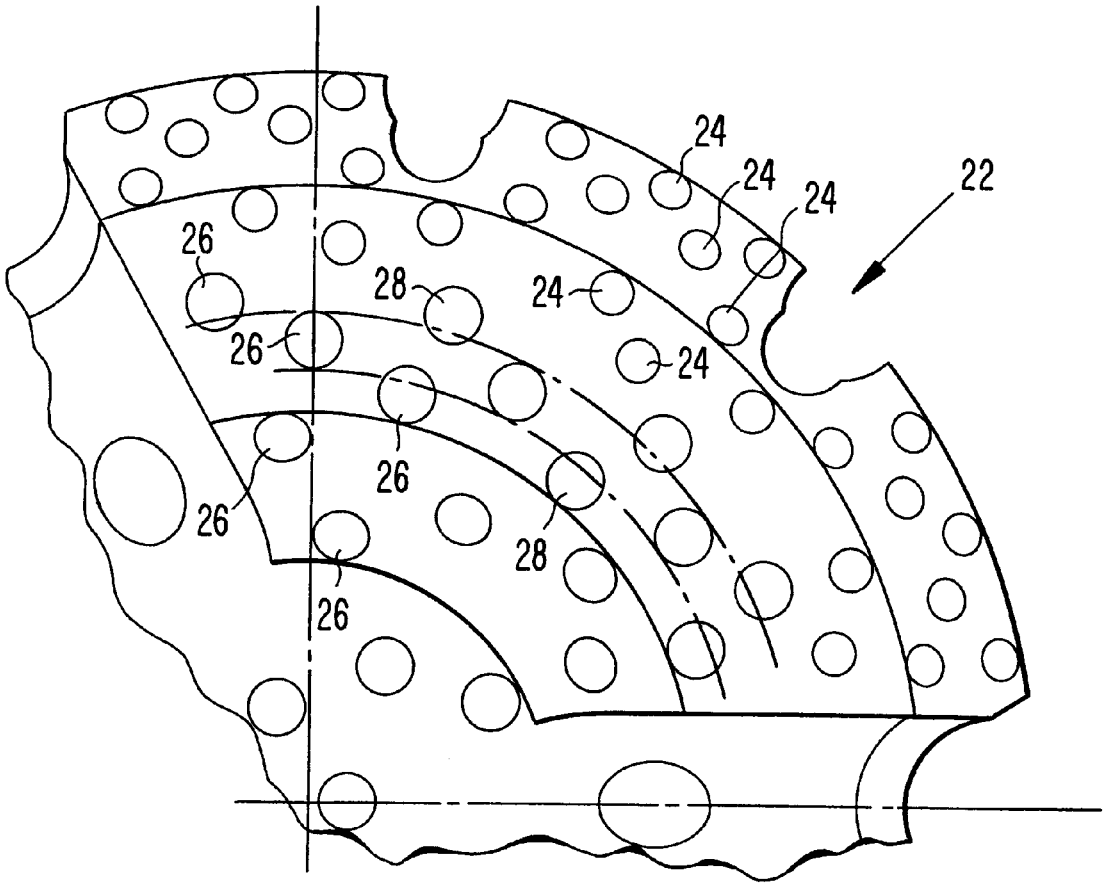
FIG. 6 is a partial front end view of a drill bit according to another embodiment of the invention.

In FIG. 6 there is depicted, a one-third segment of a relatively large bit 22 having diamond enhanced buttons 24 in the five outer rows and larger non-enhanced buttons 26 in the remaining rows. It can also be seen how the non-enhanced rows can be radially overlapped so that portions 28 of some non-enhanced buttons will lie in an adjacent row to increase the total wear volume of that row.

By employing non-enhanced face buttons, at least some of which having a larger wear volume than the enhanced gauge buttons, in accordance with FIGS. 5A, 5B and 6, the wear life of the larger non-enhanced buttons will be increased to more closely approximate that of the enhanced buttons.

Another aspect of the invention for achieving the same result involves the relative numbers of enhanced and non-enhanced buttons. That is, one of the non-enhanced face rows can be provided with at least as many buttons as the number of enhanced buttons in an outer row thereof. In the event that there is more than one enhanced gauge row, then one of the non-enhanced face rows can have more buttons than the average number of buttons in the enhanced gauge rows.

Figure 7A:
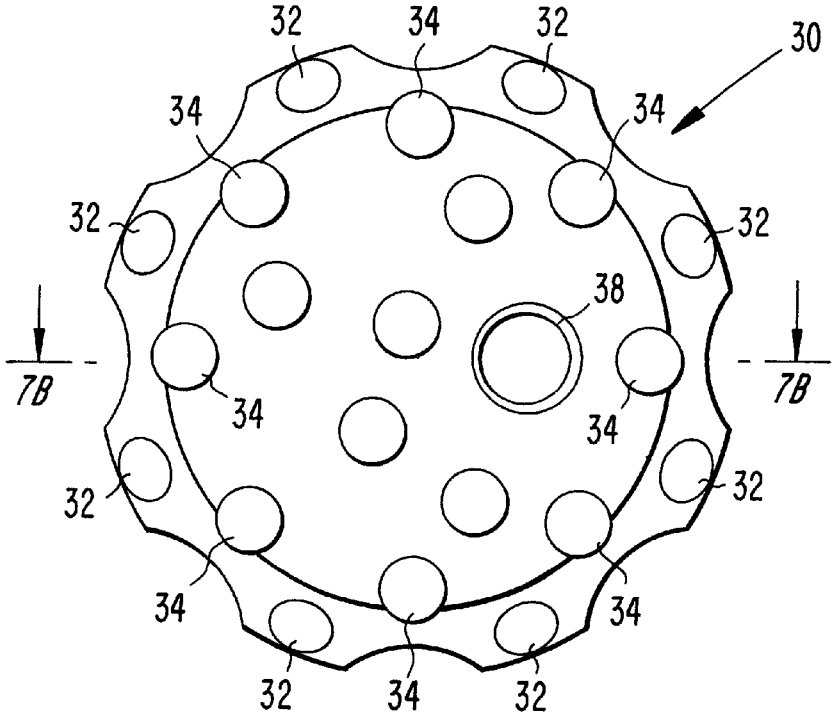
FIG. 7A is a front end view of a drill bit according to yet a further embodiment of the invention.
Figure 7B:
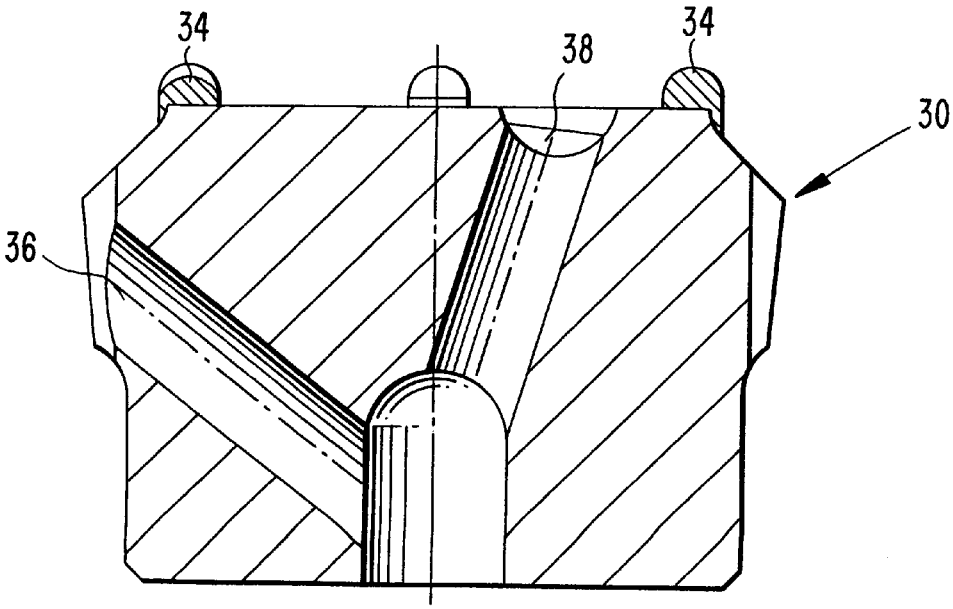
FIG. 7B is a sectional view taken along the line 7B—7B in FIG. 7A.

As an example, in FIGS. 7A, 7B an insert 30 is shown having eight enhanced gauge buttons 32, and an outer face row of eight non-enhanced buttons 34. By providing an increased number of non-enhanced buttons, the work performed thereby can be more widely distributed, thereby increasing button life. This feature requires additional area in the face of the bit for receiving the extra non-enhanced buttons. Extra area can be provided by making one or more of the flushing holes in the form of side flushing holes 36, as shown in FIG. 6B, to provide sufficient room in the face for the extra face buttons. FIGS. 7A, 7B show that one face flushing hole 38 is provided, but that flushing hole could also be in the form of a side flushing hole, if necessary.

Another aspect of the invention for balancing the wear life of enhanced and non-enhanced buttons involves the relative axial relationship between the enhanced and non-enhanced buttons. Depicted in FIG. 8 is the axial relationship between the outermost row of non-enhanced face buttons 50 and the adjacent row of enhanced buttons 52 in a conventional bit.

It should be pointed out that a button, regardless of whether it is diamond enhanced or not, includes a cylindrical base 54 and a dome shaped cutting surface. As explained earlier, the base is usually formed of cemented carbide. The cutting surface of a diamond enhanced button is formed of diamond (natural or synthetic); the cutting surface of a non-enhanced button is usually formed of cemented carbide. The circular intersection line 58 between the cylindrical base and the cutting surface defines the location of a base plane of the button.

Figure 8:
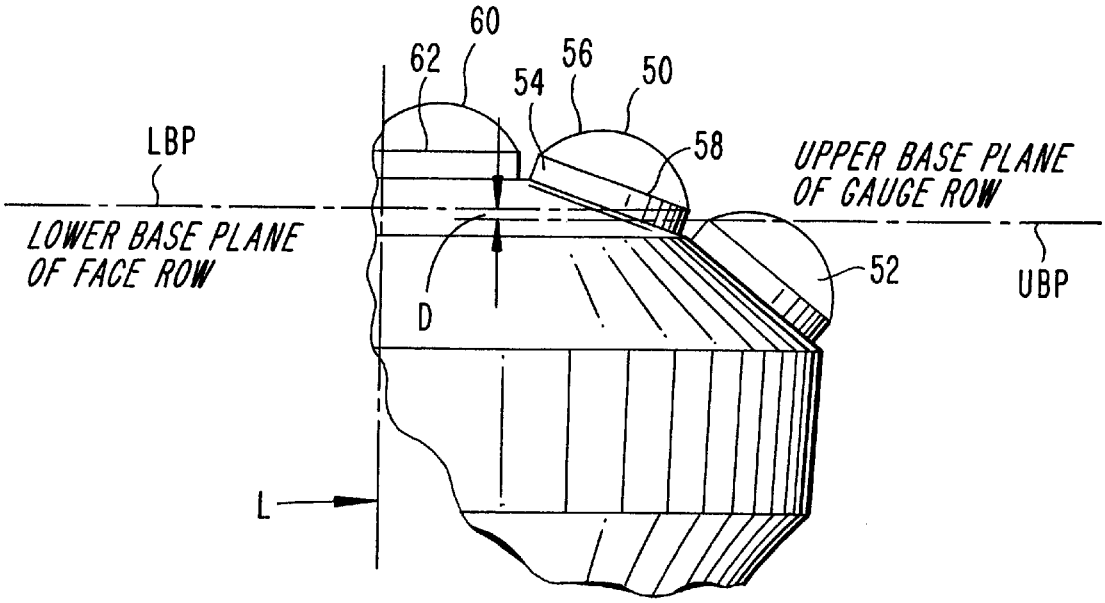
FIG. 8 (PRIOR ART)
FIG. 8 is a fragmentary side elevational view of a conventional drill bit.

For example, in FIG. 8, the buttons 50, 52 are inclined obliquely relative to the longitudinal axis L of the bit. Thus, the lowermost portion of the intersection line defines a lower base plane LBP of the non-enhanced button 50, and the uppermost portion of the enhanced button 52 defines an upper base plane UBP of the enhanced button 52. Note that a base plane ex tends perpendicular to the axis L. If a button were oriented such that its center axis were parallel to the axis L of the bit, as is the insert 60, then there would be only one base plane defined by the intersection line 62.

In conventional bits, the lower base plane LBP of the outer row of non-enhanced buttons 50 is essentially co-planar with the upper base plane UBP of the adjacent row of enhanced buttons 52. That is, the upper base plane UBP is advanced relative to the lower base plane LBP by a distance D in a range of about 0.9 to 1.2 mm.

Figure 9:
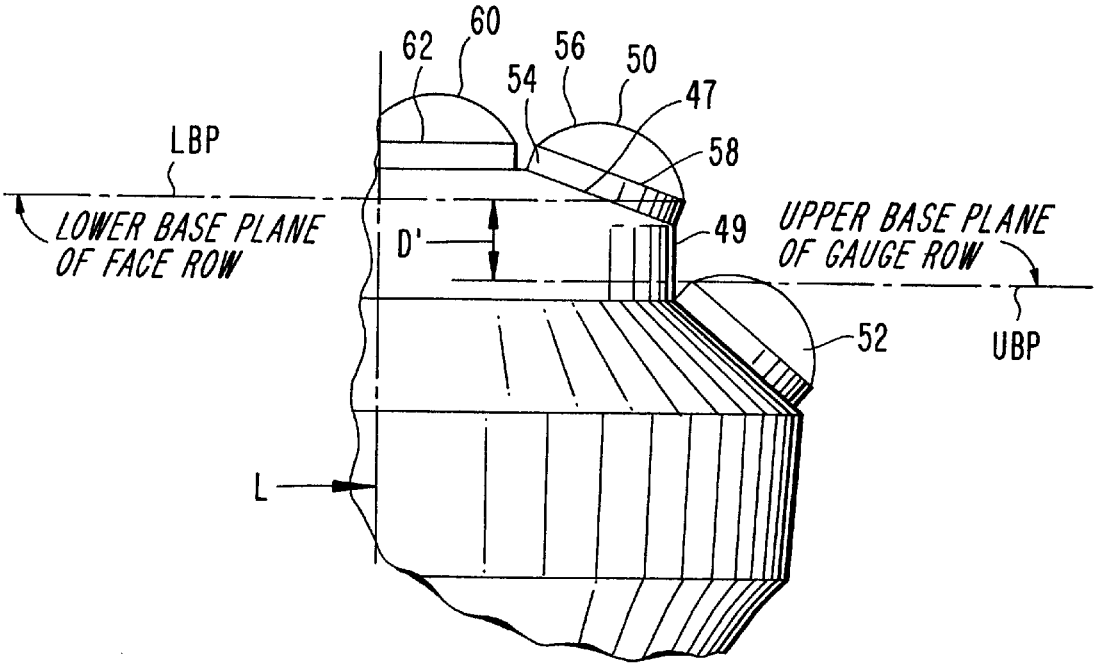
FIG. 9 is a view similar to FIG. 8 of a drill bit according to another embodiment of the present invention.

In accordance with the present invention, the lower base plane LBP of the radially outermost row of non-enhanced buttons is displaced axially forwardly with respect to an upper base plane UBP of an adjacent row of enhanced buttons disposed radially outwardly of that row of non-enhanced buttons, by a distance D' of at least 3 mm, and preferably up to 20 mm, as shown in FIG. 9. The non-enhanced buttons extend obliquely with respect to the longitudinal axis L of the bit and are mounted in an oblique facet 47 of the drill bit body. That facet 47 has been displaced axially forwardly such that a longitudinal shoulder 49 is formed.

Figure 10:
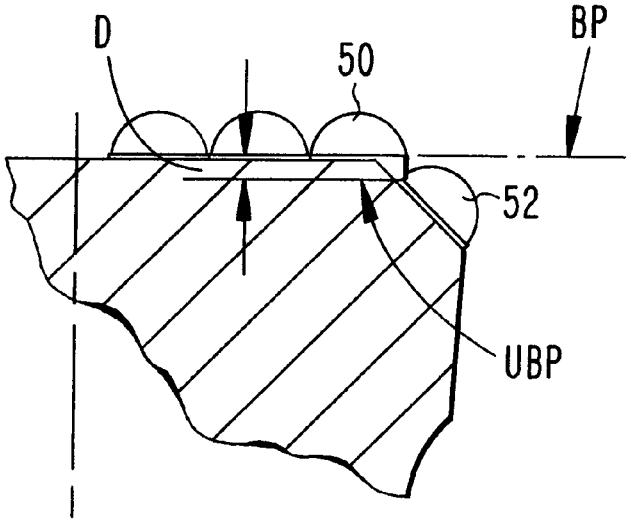
FIG. 10 is a view similar to FIG. 9 of still a further embodiment of the present invention.
Figure 11:
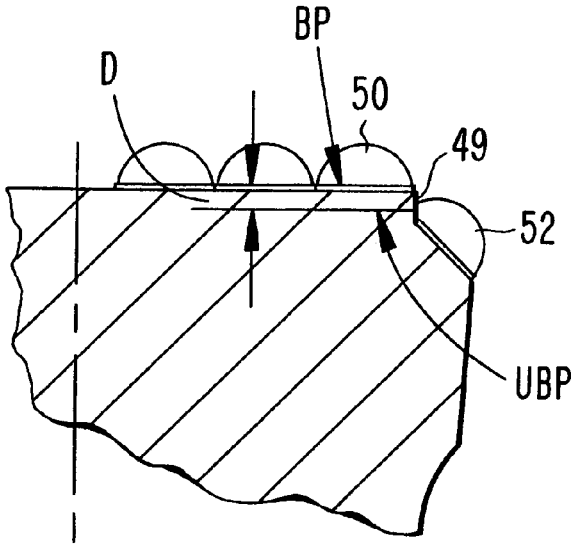
FIG. 11 is a view similar to FIG. 10 of yet another embodiment according to the invention.

In other embodiments, shown in FIGS. 10 and 11, respectively, the outermost row of non-enhanced buttons is oriented parallel to the axis L and defines a base plane BP. That base plane BP is advanced axially relative to an upper base plane UBP of the adjacent row of enhanced buttons by a distance D' which is in the range of 3 to 20 mm.

In FIG. 10, the oblique facet 51 of the steel bit body in which the enhanced buttons 52 are embedded is extended to encompass most of the bases of the non-enhanced buttons 50. On the other hand, in FIG. 11, the front face 53 of the bit body is displaced axially forwardly to form a shoulder 49, and to encompass all of the button bases.

As a result of the appreciable axial advancement of the radially outermost row of non-enhanced buttons relative to the adjacent row of enhanced buttons, as shown in FIGS. 9 to 11, a greater amount of wear of the non-enhanced buttons can occur before a reshaping thereof is required, thereby resulting in a considerable savings in time and expense.

It will be appreciated from the foregoing description that the three disclosed expedients employed to increase the wear life of non-enhanced buttons according to the present invention, i.e., increasing the size (wear volume), number, and axial displacement of some or all of the non-enhanced buttons can be employed separately, or in any desired combination. For example, one, two, or all three expedients could be employed on the same bit.

Although the present invention has been described in connection with preferred embodiments thereof, it will be appreciated by those skilled in the art that additions, deletions, modifications, and substitutions not specifically described may be made without departing from the spirit and scope of the invention as defined in the appended claims.

What is claimed is:

1. A partially enhanced drill bit comprising:

a bit body including a shank portion, and a head portion arranged integrally with the shank portion, a front end of the head portion facing away from the shank portion and defining a cutting face, the bit body including at least one flushing channel extending through the shank portion and the head portion for conducting flushing fluid;

at least one annular row of non-enhanced buttons mounted in the cutting face; and at least one annular row of enhanced buttons mounted in the cutting face radially outside of the non-enhanced buttons;

a total wear volume of non-enhanced buttons in at least one row thereof being greater than 75 percent of a total wear volume of an outermost annular row of enhanced buttons.

2. The drill bit according to claim 1, wherein a number of the non-enhanced buttons in one of the rows thereof is at least equal to a number of enhanced buttons in the outermost annular row thereof.

3. The drill according to claim 2, wherein at least some of the non-enhanced buttons have a greater wear volume than any of the enhanced buttons.

4. The drill according to claim 1, wherein at least some of the non-enhanced buttons have a greater wear volume than any of the enhanced buttons.

5. The drill according to claim 2, wherein a radially outermost row of non-enhanced buttons defines a lower base plane which is displaced axially forwardly by a distance with respect to an upper base plane of an adjacent row of enhanced buttons disposed radially outwardly of the outermost row of non-enhanced buttons; the distance being at least 3.0 mm.

6. The drill according to claim 3, wherein a radially outermost row of non-enhanced buttons defines a lower base plane which is displaced axially forwardly by a distance with respect to an upper base plane of an adjacent row of enhanced buttons disposed radially outwardly of the outermost row of non-enhanced buttons; the distance being at least 3.0 mm.

7. The drill according to claim 4, wherein a radially outermost row of non-enhanced buttons defines a lower base plane which is displaced axially forwardly by a distance with respect to an upper base plane of an adjacent row of enhanced buttons disposed radially outwardly of the outermost row of non-enhanced buttons; the distance being at least 3.0 mm.

8. The drill according to claim 1, wherein a radially outermost row of non-enhanced buttons defines a lower base plane which is displaced axially forwardly by a distance with respect to an upper base plane of an adjacent row of enhanced buttons disposed radially outwardly of the outermost row of non-enhanced buttons; the distance being at least 3.0 mm.

9. A partially enhanced drill bit comprising:

a bit body including a shank portion, and a head portion arranged integrally with the shank portion, a front end of the head portion facing away from the shank portion and defining a cutting face, the bit body including at least one flushing channel extending through the shank portion and the head portion for conducting flushing fluid;

at least one annular row of non-enhanced buttons mounted in the cutting face; and at least one annular row of enhanced buttons mounted in the cutting face radially outside of the non-enhanced buttons;

a number of the non-enhanced buttons in one of the rows thereof being at least equal to a number of enhanced buttons in an annular outermost row of enhanced buttons.

10. The drill bit according to claim 9, wherein at least some of the non-enhanced buttons have a greater wear volume than any of the enhanced buttons.

11. The drill bit according to claim 10, wherein a radially outermost row of non-enhanced buttons defines a lower base plane which is displaced axially forwardly by a distance with respect to an upper base plane of an adjacent row of enhanced buttons disposed radially outwardly of the outermost row of non-enhanced buttons; the distance being at least 3.0 mm.

12. The drill bit according to claim 9, wherein a radially outermost row of non-enhanced buttons defines a lower base plane which is displaced axially forwardly by a distance with respect to an upper base plane of an adjacent row of enhanced buttons disposed radially outwardly of the outermost row of non-enhanced buttons; the distance being at least 3.0 mm.

13. A drill bit according to claim 9, wherein the flushing channel terminates in a side of the body.

14. A partially enhanced drill bit comprising:

a bit body including a shank portion, and a head portion arranged integrally with the shank portion, a front end of the head portion facing away from the shank portion and defining a cutting face, the bit body including at least one flushing channel extending through the shank portion and the head portion for conducting flushing fluid;

at least one annular row of non-enhanced buttons mounted in the bit body; and at least one annular row of enhanced buttons mounted in the bit body radially outside of the non-enhanced buttons;

at least some of the non-enhanced buttons having a greater wear volume than any of the enhanced buttons.

15. A partially enhanced drill bit comprising:

a bit body including a shank portion, and a head portion arranged integrally with the shank portion, a front end of the head portion facing away from the shank portion and defining a cutting face, the bit body including at least one flushing channel extending through the shank portion and the head portion for conducting flushing fluid;

at least one annular row of non-enhanced buttons mounted in the bit body; and at least one annular row of enhanced buttons mounted in the bit body radially outside of the non-enhanced buttons;

a radially outermost row of non-enhanced buttons defining a lower base plane which is displaced axially forwardly by a distance with respect to an upper base plane of an adjacent row of enhanced buttons disposed radially outwardly of the outermost row of non-enhanced buttons, the distance being at least 3.0 mm.

16. The drill bit according to claim 15, wherein the outermost non-enhanced buttons are oriented parallel to a longitudinal axis of the bit.

17. The drill bit according to claim 15, wherein the outermost non-enhanced buttons are inclined at an oblique angle with respect to a longitudinal axis of the bit.

18. A partially enhanced drill bit comprising:

a bit body;

at least one annular row of non-enhanced buttons mounted in the bit body;

a plurality of radially spaced annular rows of enhanced buttons mounted in the bit body radially outwardly of the non-enhanced buttons;

a number of non-enhanced buttons in at least one of the rows thereof being greater than an average number of enhanced buttons in the rows thereof.

19. The drill bit according to claim 1 wherein each of the buttons is shaped symmetrically about its own center axis.

20. The drill bit according to claim 9, wherein each of the buttons is shaped symmetrically about its own center axis.

21. The drill bit according to claim 14 wherein each of the buttons is shaped symmetrically about its own center axis.

22. The drill bit according to claim 15 wherein each of the buttons is shaped symmetrically about its own center axis.

23. The drill bit according to claim 18 wherein each of the buttons is shaped symmetrically about its own center axis.

* * * * *